US006379750B1

(12) United States Patent
Wojcik et al.

(10) Patent No.: US 6,379,750 B1
(45) Date of Patent: Apr. 30, 2002

(54) PROCESS FOR ENHANCING THE ADHESION OF ORGANIC COATINGS TO METAL SURFACES

(76) Inventors: Gerald Wojcik, 429 Prospect St., Thomaston, CT (US) 06787; Melvin R. Jenkins, 8743 N. Christine Dr., Brighton, MI (US) 48114

( * ) Notice: Subject to any disclaimer, the term of this patent is extended or adjusted under 35 U.S.C. 154(b) by 0 days.

(21) Appl. No.: 09/718,910

(22) Filed: Nov. 22, 2000

Related U.S. Application Data

(63) Continuation-in-part of application No. 09/421,204, filed on Oct. 21, 1999, now Pat. No. 6,206,981.

(51) Int. Cl.[7] ..... B05D 1/36

(52) U.S. Cl. ..... 427/388.1; 427/409; 148/243; 148/264; 148/275

(58) Field of Search ..... 427/388.1, 409; 148/243, 264, 275

(56) References Cited

U.S. PATENT DOCUMENTS

| | | | | |
|---|---|---|---|---|
| 2,796,370 A | | 6/1957 | Ostrander et al. | 148/6.2 |
| 2,945,778 A | * | 7/1960 | Lipinski | 148/6.24 |
| 2,945,779 A | * | 7/1960 | Lipinski | 148/6.24 |
| 3,239,467 A | | 3/1966 | Lipinski | 252/144 |
| 4,148,670 A | | 4/1979 | Kelly | 148/6.27 |
| 4,451,304 A | | 5/1984 | Batiuk | 148/6.27 |

* cited by examiner

*Primary Examiner*—Erma Cameron
(74) *Attorney, Agent, or Firm*—Carmody &Torrance LLP

(57) ABSTRACT

A process is described for increasing the adhesion of organic coatings to metal surfaces, particularly aluminum and aluminum alloys. The process involves the utilization of an adhesion promoting composition in treating the metal surface prior to application of the organic coating. The adhesion promoting composition comprises a nitro sulfonic acid. A chromating step is optionally employed.

12 Claims, No Drawings

PROCESS FOR ENHANCING THE ADHESION OF ORGANIC COATINGS TO METAL SURFACES

This application is a continuation-in-part of U.S. Ser. No. 09/421,204, filed Oct. 21, 1999, now U.S. Pat. No. 6,206, 981.

BACKGROUND OF INVENTION

The present invention relates to a process for improving the adhesion of organic coatings such as paint to metal surfaces, particularly aluminum and aluminum alloys. The process cleans and prepares the metal surfaces such that subsequently applied organic coatings to the metal surfaces, such as paint, adhere to the metal surface in a superior fashion.

A typical cleaning/treatment process for metallic surfaces generally removes residual surface soils and the natural oxide layer found on metallic surfaces. The natural oxide layer will then reform in time. This time will vary depending on the presence of corrosion inhibitors within the process, the environment, and the inherent nature of the substrate being treated. As such, the net result of such a treatment can be the removal of surface contaminants. Although this is desirable, it does not necessarily significantly enhance subsequent bonding of organic adhesives or coatings to the metallic surface. However, bonding can be further improved through the use of processes that clearly affect the surface energy of the metallic surface and that form surface layers that are more uniform and, structurally and chemically stable, than the natural oxide layers. The invention described herein is believed to address these issues and to substantially increase the adhesion of subsequent organic coatings to the treated metal surface.

SUMMARY OF THE INVENTION

The proposed invention teaches the treatment of metal surfaces, particularly aluminum or aluminum alloy surfaces with a process comprising:

1. Contacting the metal surface with an adhesion promoting solution comprising:

(a) anitro sulfonic acid; and (b) optionally, but preferably a glycol ether.

2. Subsequently applying an organic coating to the metal surface.

The adhesion promoting solution of this invention may also optionally, but preferably, comprise an oxidizing acid other than the nitro sulfonic acid, surfactants, and/or 1, 2 bis (beta-chloroethoxy) ethane.

DETAILED DESCRIPTION OF THE INVENTION

The inventors herein have discovered that treatment of metal surfaces, particularly surfaces of aluminum and aluminum alloys, with a specific process greatly improves the adhesion of subsequently applied organic coatings to such metal surfaces. In order to accomplish this, the inventors propose the following process:

1. Contacting the metal surface with an adhesion promoting solution comprising:

a) a nitro sulfonic acid; and b) optionally, but preferably, a glycol ether.

2. Subsequently applying an organic coating to the metal surface.

Many metals may be treated with the process of the invention but the inventor has found the process to be particularly useful in preparing aluminum and aluminum alloys for painting. Surprisingly and unexpectedly, the proposed process has been discovered to significantly increase the adhesion of organic layers, such as paints and primers, to the treated metallic surface without the use of a chromate conversation coating. Although a chromate conversation coating may be applied after the process of this invention but before the application of the organic coating, it has surprisingly been found that such a coating is unnecessary. Additionally it has been further surprisingly found that metal surfaces treated with the process of this invention may be effectively painted using paint primers that do not contain chrome species (i.e. non-chrome containing primers). Typically chrome containing primers have been used to improve the corrosion resistance of the coated metal surface, particularly aluminum surfaces. Because of the increased adhesion achievable with this process, non-chrome containing primers may now be effectively utilized without significant decreases in corrosion protection.

The adhesion promoting composition may contain a glycol ether. Preferably the glycol ether will be a lower alkyl ether of ethylene glycol, propylene glycol, polyethylene glycol and polyproplene glycol. Some examples of appropriate glycol ethers include ethylene glycol mono butyl ether, ethylene glycol monomethyl ether, propylene glycol monomethyl ether, diethylene glycol monomethyl ether, diethylene glycol mono-n-butyl ether, diethylene glycol monohexyl ether, triethylene glycol monomethyl ether, other similar glycol ethers and mixtures of any of the foregoing. The concentration of the glycol ether may range from 2 to 40 percent by weight but is preferably from 10 to 20 percent by weight. Ethylene glycol mono-butyl ether, commonly marketed under the tradename Butyl Cellosolve, is a preferred glycol ether.

The adhesion promoting composition contains a nitro sulfonic acid. Examples of useful nitro sulfonic acid include p-nitro benzene sulfonic acid, M-nitrobenzene sulfonic acid, 2-chloro-5 nitrobenzene sulfonic acid, 2, 4 dinitrobenzene sulfonic acid, p-nitrotoluene sulfonic acid, 3, 5 dinitro-p-toluene sulfonic acid and the like. The concentration of the nitrosulfonic acid may range from 2 to 10 percent by weight but is preferably from 3 to 8 percent by weight.

The adhesion promoting composition of the proposed process optionally contains 1, 2-bis (beta-chloroethoxy) ethane at a concentration of from 0.1 to 10 percent by weight. Preferably the concentration of 1, 2-bis (beta-chloroethoxy) ethane is from 0.5 to 2.0 percent by weight. 1, 2-bis (beta-chloroethoxy) ethane is only sparingly soluble in water, however a glycol ether, or equivalent substance or solvent, may be utilized to increase the solubility of 1, 2-bis (beta-chloroethoxy) ethane in the adhesion promoting composition.

The adhesion promoting composition may contain an oxidizing acid other than the nitro sulfonic acid. As indicated, the composition will also comprise a nitro sulfonic acid. The nitro sulfonic acid may also act as the oxidizing acid. The oxidizing acid is preferably nitric acid and/or a nitro sulfonic acid but most preferably both nitric acid and a nitro sulfonic acid are utilized in combination. The concentration of the oxidizing acid may range from 0.1 to 20 percent by weight, but is preferably from 0.1 to 10 percent by weight. If nitric acid is utilized in combination with a nitro sulfonic acid, then the concentration of nitric acid (69%) is preferably from 0.1 to 2 percent by weight and the concentration of the nitrosulfonic acid is from 2 to 8 percent by weight.

The adhesion promoting composition may also contain surfactants or water soluble polymers. The inventors have found that the addition of non-ionic surfactants and water soluble polymers are advantageous to the performance of the adhesion promoting composition. In particular homopolymers or copolymers of ethylene oxide and/or propylene oxide have been found to be useful. In addition non-ionic surfactants have also proven to be useful. The concentration of surfactant and water soluble polymers in the adhesion promoting composition may range from 0.5 to 3 percent by weight but is preferably from 1 to 2 percent by weight.

Finally, it may be advantageous to incorporate thickeners into the formulation, if the adhesion promoting composition is to be applied to vertical surfaces. A variety of thickness, such as fumed silica, is known in the art.

As noted, although a chromate conversation coating may be employed after the treatment of this process and before the application of the organic coating, it has surprisingly been discovered that a chromating step is unnecessary and that increased and acceptable adhesion can be achieved without the need for an intermediate chromating step. The elimination of a chromating step is advantageous from economical, environmental and safety points of view. However, if desired, intermediate chromating may be utilized. If desired, the chromating composition to be used in the process can be any composition capable of effectively creating a chromate conversion coating on the surface of the metal being treated. In this regard the teachings of U.S. Pat. No. 2,796,370 are herein incorporated by reference in their entirety. The inventors have found Iridite 14-2, a chromating solution available from MacDermid, Incorporated of 245 Freight Street, Waterbury, Conn., to be particularly useful in this regard.

The adhesion promoting composition and the chromating composition, if used, may be applied to the metal surface by either immersion, spray or equivalent method. The compositions should preferably remain in contact with the metal surface for a minimum of several minutes.

Although not wishing to be bound by theory, it is believed that treating the metallic surface with the adhesion promoting composition increases the surface energy of the treated surface. It is further believed a uniform and structurally strong surface layer is formed that comprises both metallic oxides and organo metallic compounds. The nitrosulfonic acid is thought to perform a central role in the formation of these surface organometallic species and that these surface organometallic species are the primary reason for the improved adhesion of the organic layer to the treated metal surface. The surface treated with the adhesion promoting composition is unique in several aspects. The organometallic structure on the metallic surface maintains the modified surface energy for an extended period and can therefore effectively be painted for about several months after treatment.

The inventors have found an unexpected synergism to occur when utilizing both the adhesion promoting composition and the chromating composition. The synergism is particularly unexpected since both the adhesion promoting composition and the chromating composition are reactive coatings (ie. react with the surface treated to create a modified surface). Conventional wisdom would dictate that it would not be advisable to employ two reactive coatings, one on top of the other since the first should either inhibit the formation of the second or the second will overcome and replace the first. In this case the unexpected synergism between the two coatings indicates that the coatings unexpectedly co-exist on the treated surface in some way.

The inventors have found the process of this invention particularly useful in preparing aluminum or aluminum alloy surfaces for painting. In this case, typically both a primer and the finish paint are applied over the treated surface. Historically, chrome containing paint primers have been widely used for increased corrosion protection. It has been surprisingly found that surfaces treated with the process of this invention can be painted with a non-chrome containing primer (i.e. a primer that does not contain chrome species) while achieving the same or similar levels of corrosion protection. It is believed that this advantage is achieved because the organic coatings (i.e. primer and paint) are able to better wet and adhere to the surface treated with the process of this invention.

The following example illustrates the foregoing invention but should not be taken as limiting in any way.

EXAMPLE I

An air-foil shaped piece of aluminum metal was processed through the following process:

| | | Time |
|---|---|---|
| 1. | alkaline soak cleaner to remove any oily residues | 7 minutes |
| 2. | clean water rinse | 2 minutes |
| 3. | adhesion promoting composition | 1.5 minutes |
| 4. | clean water rinse | 2 minutes |
| 5. | dry | |

The adhesion promoting composition contained the following:

| Substance | Concentration (weight percent) |
|---|---|
| ethylene glycol monobutyl ether | 16 |
| p-nitro toluene sulfonic acid | 6 |
| water | 78 |

An epoxy primer and polyester top coat was applied to the processed aluminum specimen and allowed to cure. The adhesion of the paint was checked using the rain erosion method, a paint adhesion test method well known in the aerospace industry. In the rain erosion test water droplets impinge at high speed upon the line of demarcation between a painted and unpainted area on the specimen. The test is intended to simulate the water-blast stripping or eroding effect on the painted surface of an aircraft moving at high speed. A reasonable pass-fail criterion for this test requires that no greater than ¼ inch erosion occur behind the leading edge of the paint line. The specimen which was prepared in accordance with this example yielded a passing adhesion valve of less than ⅛ inch erosion.

EXAMPLE II

Example I was repeated except that only steps 1, 2 and 5 of the process were employed (ie. the aluminum was cleaned, rinsed and dried only). The same paint system cited in Example I was used along with the same testing scheme. The adhesion was found to be lacking in that the rain erosion test produced a namimum allowable erosion of ¼ inch or more.

EXAMPLE III

Example I was repeated except that the adhesion promoting composition comprises the following:

| Substance | Concentration (weight percent) |
|---|---|
| ethylene glycol monobutyl ether | 16 |
| p-nitro toluene sulfonic acid | 6 |
| 1,2 bis (beta-chloroethoxy) ethane | 1 |
| nitric acid (42 BE) | 0.4 |
| ethylene oxide homopolymer (MW-7700) | 0.5 |
| ethoxylated nonionic surfactant | 1 |
| water | 75.1 |

The specimen was prepared in accordance with the procedures of Example I and yielded a passing adhesion value of less than ⅛ inch erosion.

EXAMPLE IV

Example III was repeated except in this case a chromate conversation coating (MacDermid Iridite 14-2 chromate, available from MacDermid, Incorporated, 245 Freight St., Waterbury Conn. 06702) followed by a clean water rinse was applied between steps 4 and 5. The specimen in this example yielded a passing adhesion value of less than ⅛ inch erosion.

We claim:

1. A process for improving the adhesion of an organic coating to a metal surface, said process comprising:

a) contacting the metal surface with an adhesion promoting composition comprising:
   1. a glycol ether; and
   2. a nitro sulfonic acid; and thereafter b) contacting the metal surface with a chromating composition; and c) subsequently applying an organic coating to the metal surface.

2. A process according to claim 1 wherein the metal surface comprises a metal selected from the group consisting of aluminum and aluminum alloys.

3. A process according to claim 1 wherein the adhesion promoting composition also comprises at least one material selected from the group consisting of surfactants, ethylene oxide polymers, propylene oxide polymers, oxidizing acids, 1, 2 bis (beta-chloroethoxy) ethane, and mixtures of any of the foregoing.

4. A process according to claim 3 wherein the metal surface comprises a metal selected from the group consisting of aluminum and aluminum alloys.

5. A process according to claim 1 wherein the adhesion promoting composition also comprises a thickener.

6. A process for improving the adhesion of an organic coating to a metal surface, said process comprising:

a) contacting the metal surface with an adhesion promoting composition comprising a nitro sulfonic acid;

b) contacting the metal surface with a chromating composition; and c) subsequently applying an organic coating to the metal surface.

7. A process according to claim 6 wherein the metal surface comprises a metal selected from the group consisting of aluminum and aluminum alloys.

8. A process according to claim 6 wherein the adhesion promoting composition also comprises at least one material selected from the group consisting of surfactants, ethylene oxide polymers, propylene oxide polymers, oxidizing acids, 1, 2 bis (beta-chloroethoxy) ethane, glycol ethers, and mixtures of any of the foregoing.

9. A process according to claim 8 wherein the metal surface comprises a metal selected from the group consisting of aluminum and aluminum alloys.

10. A process according to claim 8 wherein the organic coating comprises a paint primer which is substantially free of chrome containing species.

11. A process according to claim 6 wherein the adhesion promoting composition also comprises a thickener.

12. A process according to claim 6 wherein the organic coating comprises a paint primer which is substantially free of chrome containing species.

* * * * *